United States Patent [19]

Takagi et al.

[11] Patent Number: 4,598,377

[45] Date of Patent: Jul. 1, 1986

[54] METHOD OF CONTROLLING THE ROLLING EFFICIENCY IN HOT ROLLING

[75] Inventors: Kiyoshi Takagi; Ichiro Toda, both of Okayama; Yoshiharu Hamasaki; Yoshinori Wakamiya, both of Hyogo, all of Japan

[73] Assignees: Mitsubishi Denki Kabushiki Kaisha; Kawasaki Steel Corporation, both of Japan

[21] Appl. No.: 431,927

[22] Filed: Sep. 30, 1982

[30] Foreign Application Priority Data

Oct. 5, 1981 [JP] Japan ..... 56-158431

[51] Int. Cl.[4] ..... G06F 15/46; B21B 27/06; B21B 37/00

[52] U.S. Cl. ..... 364/472; 72/202; 72/11; 72/12

[58] Field of Search ..... 364/472, 478, 479; 72/202, 12, 11, 7; 177/66, 1

[56] References Cited

U.S. PATENT DOCUMENTS 3,834,473 9/1974 Girard et al. ..... 364/472
4,223,385 9/1980 Miller et al. ..... 364/472
4,485,652 12/1984 Shoji et al. ..... 72/202 X

FOREIGN PATENT DOCUMENTS 584917 12/1977 U.S.S.R. ..... 72/202

OTHER PUBLICATIONS

"Combination Slab and Plate Mill Rolls Under Computer Control", *Iron and Steel Engineer,* May 1965, pp. 134–144, by Jones et al.

*Primary Examiner*—Jerry Smith
*Assistant Examiner*—Jon D. Grossman
*Attorney, Agent, or Firm*—Sughrue, Mion, Zinn, Macpeak, and Seas

[57] ABSTRACT

A method of controlling the rolling efficiency in a continuous hot rolling process including the steps of inputting a total weight of and the time intervals of slabs already extracted from a heating furnace in a period from the present time up to any previous time, a total weight and a forecast furnace residence time of slabs charged in the heating furnace and a total weight of any number of slabs to be charged, and calculating the desired rolling efficiency of the slabs to be charged to thereby control the overall average rolling efficiency to a predetermined value. With such a method, the total weight of the slabs to be rolled in a unit time is maintained to a predetermined value.

2 Claims, 4 Drawing Figures

METHOD OF CONTROLLING THE ROLLING EFFICIENCY IN HOT ROLLING

BACKGROUND OF THE INVENTION

This invention concerns a process of controlling the overall average rolling efficiency to a predetermined value in a hot rolling process.

In the continuous hot rolling process, the rolling order and the rolling pitch are determined in line with the entire production plan. However, the rolling plan is apt to be disrupted, due to the interruption of the rolling caused by troubles in the mill line or uncontrolled excessive increase in the rolling pitch. Usually, the recovery of the rolling plan has heretofore been completely left to the operator's judgment.

It will be apparent that such disturbance in the rolling plan gives an undesired effect also for the pre-stage and the post-stage to the continuous hot rolling process and, is undesired in view of the entire production plan.

SUMMARY OF THE INVENTION

This invention has been made in view of the foregoing state of the art and it is an object thereof to provide a process for maintaining the rolling efficiency of a hot strip mill, that is, the total weight of the slabs to be rolled in a unit of time to a predetermined value. The subject matter of this invention is related to co-pending U.S. application Ser. No. 431,533 filed on Sept. 30, 1982.

DETAILED DESCRIPTION OF THE PREFERRED EMBODIMENTS

The concept of this invention will now be described specifically referring to the principal chart shown in FIG. 1.

A hot strip mill is usually run continuously through 24 hours per day, during which each group of operators works on the production alternately for each 8 hour period, and a rolling schedule and a required number of rolling tons are allocated to each of the groups based on the production plan. Accordingly, each of the groups works for the number of rolling tons set per unit hour (hereinafter referred to as a rolling efficiency TPH: Tons Per Hour) and it is important to maintain the desired TPH always constant irrespective of the interruption of the rolling caused by troubles generated from the heating furnace for the down coiler or by roll exchange apparatus for the mills.

Figure 1:
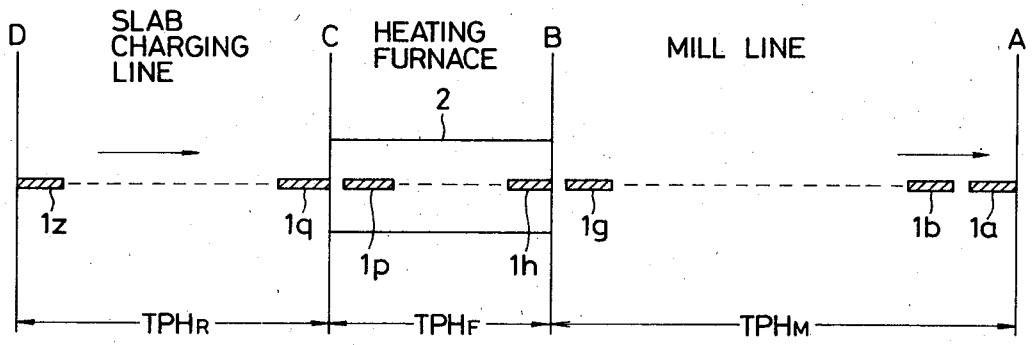
FIG. 1 shows the concept of this invention.

Assuming the total weight (tons) of slabs 1*a*–1*g* extracted from the heating furnace 2 and rolled in a period $T_M$ between the present time and a past time point as $W_M$, in FIG. 1, the rolling efficiency $TPH_M$ therebetween is represented as:

$$TPH_M = W_M / T_M \tag{1}$$

While on the other hand, since the extraction pitch $\tau$ for each of the slabs already charged at present in the heating furnace 2 (the time interval between an extraction of a preceding slab from the furnace and an extraction of a next slab between the furnace) is given previously at the time when the subsequent slab is charged into the heating furnace 2, the rolling efficiency $TPH_F$ desired for the slabs in the heating furnace 2 is represented as:

$$TPH_F = \frac{\sum_{i=1}^{n_F} W_{Fi}}{\sum_{i=1}^{n_F} \tau_{Fi}} = \frac{W_F}{T_F} \tag{2}$$

where $W_{Fi}$: weight of the ith slab in the heating furnace 2 (tons), $\tau_{Fi}$: extraction pitch for the ith slab in the furnace 2, $n_F$: number of slabs in the heating furnace 2, $W_F$: total weight of the slabs in the heating furnace 2, and $T_F$: furnace residence time of the last slab in the heating furnace 2.

Now, assuming a certain point D upstream of the charging point C to the heating furnace 2, the extraction pitch for each of the $n_R$ slabs is determined by determining a desired rolling efficiency $TPH_R$ for the $n_R$ slabs presently placed between the point D and the charging point C such that a certain rolling efficiency $TPH_{AV}$ is established for all the slabs 1*a* to 1*z* and is then rolled.

That is, the desired rolling efficiency $TPH_{AV}$ as the entire slabs from the slab 1*a* to the slab 1*z* can be represented as:

$$TPH_{AV} = \frac{W_R + W_F + W_M}{T_R + T_F + T_M} \tag{3}$$

where $W_R$: the total weight of the slabs between the point D and the charging point C, and $T_R$: R slab transit time between the point D and the charging point C for the slab 1*z*. While on the other hand, since the desired rolling efficiency $TPH_R$ for the slabs existing between the point D and the charging point C is represented as:

$$TPH_R = W_R / T_R \tag{4}$$

the desired rolling efficiency can be determined according to equations (3) and (4) as:

$$TPH_R = TPH_{AV} \cdot \frac{W_R}{W_R + W_F + W_M - TPH_{AV}(T_F + T_M)} \tag{5}$$

Further, in the operation for the heating furnace 2, it is required to forecast the extraction pitch of the slab at the time when it is charged into the furnace. The forecast extraction pitch can be calculated based on the desired rolling efficiency TPHR determined from equation (5), with an assumption that the extraction pitch is equal for each of the $n_R$ slabs, as follows:

$$\tau_R = (W_R / n_R) \cdot (1 / TPH_R \tag{6}$$

Figure 2:
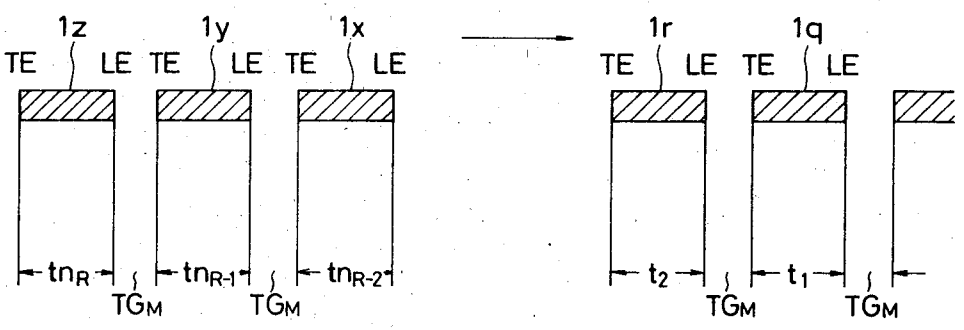
FIG. 2 is a chart for explaining the method of determining the forecast extraction pitch for each of the slabs.

However, since parameters such as the size for each of the slabs and the rolling speed on the mill line might be different, the forecast extraction pitch determined as above may introduce the loss of balance into a gap time for each of the slabs (the gap time being the time interval between a passage of a trailing end of a slab at a time point and a passage of the leading end of the subsequent slab at the same time point) on the mill line, to thereby cause instability in view of the mill operation. In order to avoid this, the forecast extraction pitch $\tau_{Ri}$, for each of the slabs existing between the point D and the charging point C, is determined so that the gap time at a particular point on the mill line, for example, at a first finish mill stand, may be maintained at a predetermined constant value and a desired rolling efficiency $TPH_R$ may be attained. That is, in FIG. 2, assuming the rolling time between a time value when a leading end LE of a slab is gripped by the first finish mill stand and a time value when a trailing end TE of that slab is discharged therefrom as ti and assuming the gap time between the discharge of the trailing end of the slab from the stand and a gripping of the leading end of the subsequent slab as $TG_M$ which is the same for each of the slabs 1*q* to slab 1*z*, $TPH_M$ must be as follows:

$$TPH_M = \frac{W_M}{\sum_{i=1}^{n_R} (ti + TG_M)} \tag{7}$$

Since the rolling time ti can be determined previously by the rolling schedule for the slab on the mill line, the gap time can be otained as:

$$TG_M = \frac{1}{n_R}\left(\frac{W_M}{TPH_M} - \sum_{i=1}^{n_R} ti\right) \tag{8}$$

Accordingly, the forecast extraction pitch $\tau_{Ri}$ can be determined as:

$$\tau_{Ri} = ti + TG_M \tag{9}$$

In the foregoing explanation, although the point D is set upstream of the carging point C, it will be apparent that the point D may be set to an appropriate point in the heating furnace and that slabs to be considered which are already extracted and rolled can also be selected optionally.

Figure 3:
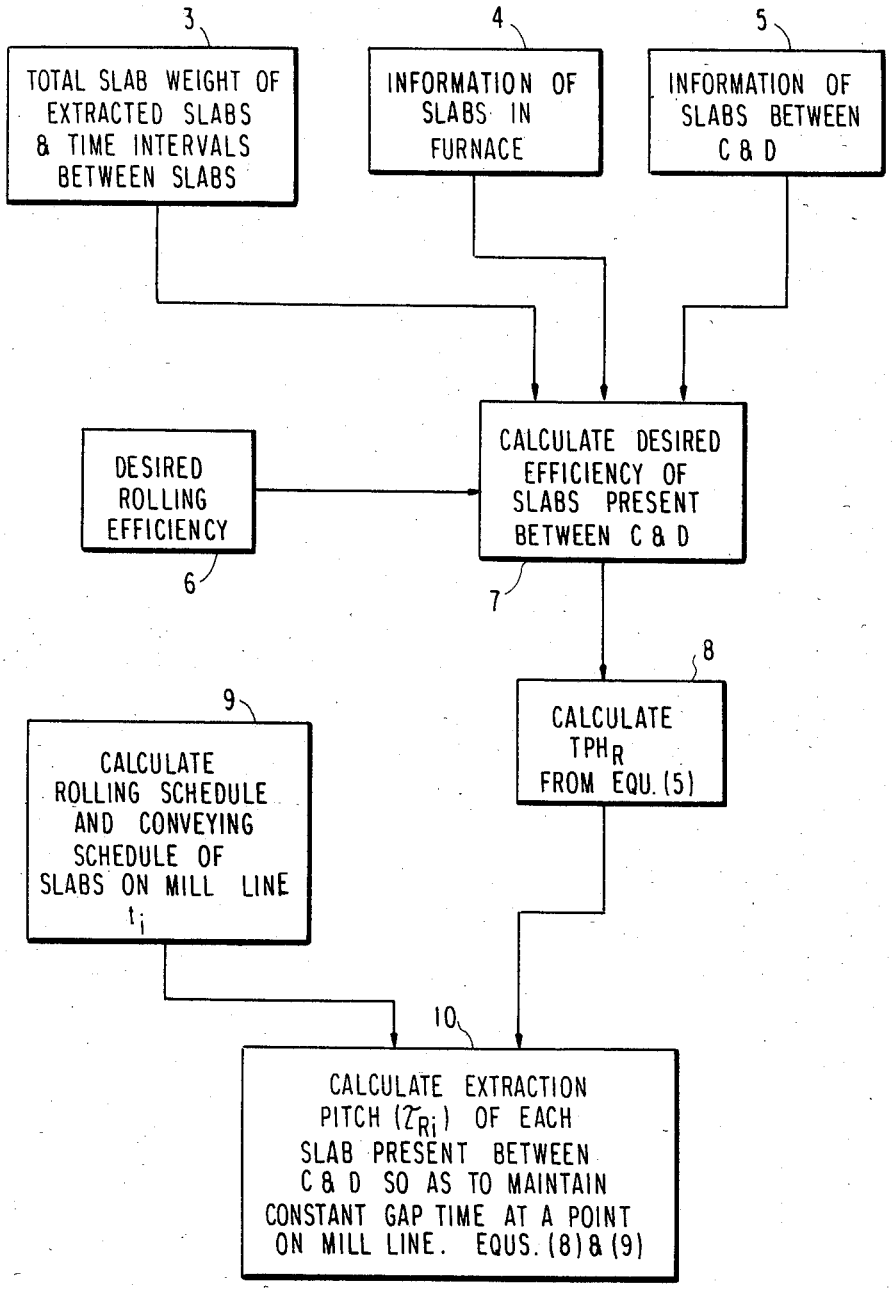
FIG. 3 is a flow chart showing the calculating procedures of the equations (8) and (9)
Figure 4:
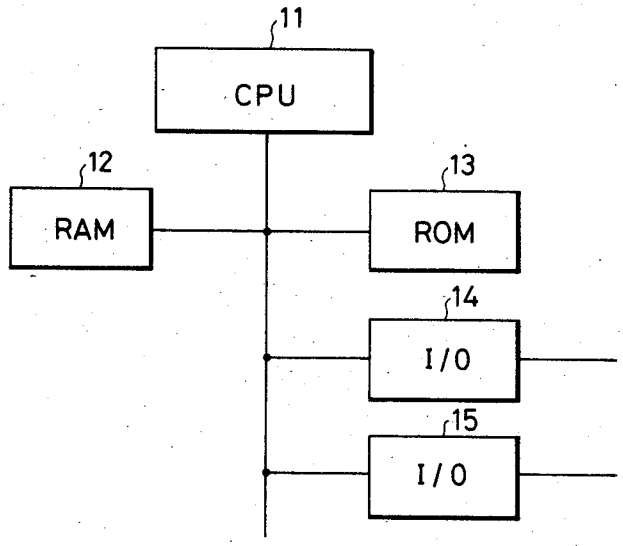
FIG. 4 shows an apparatus carrying out the procedures shown in FIG. 3, schematically.

FIG. 3 is a flow chart showing the procedures for calculating the equations (8) and (9), and FIG. 4 shows an apparatus carrying out the procedures shown in FIG. 3, schematically.

Data necessary for the calculation are inputted from I/O devices 14 and 15 to a data memory 12. A central processing unit 11 takes out necessary data for the calculations from the data memory 12 and executes the calculations in accordance with programs stored in a program memory 13.

As stated above specifically, stable rolling on the mill line can be carried out while keeping a desired rolling efficiency in accordance with the forecast extraction pitch for each of the slabs presently situated between a charging point of the furnace and a time point upstream thereof. The extraction pitch is calculated according to equations (5), (7), (8) and (9) by using the total weight (tons) of the time intervals between slabs extracted from the heating furnace and rolled over a period from the present time up to any selected past time, the total weight (tons) and the furnace residence time of slabs charged already in the heating furnace, the total weight (tons) of slabs present between an optional point upstream of the heating furnace and the charging point to the heating furnace, the transit time from the optional point to the charging point and the rolling time on the mill line.

What is claimed is:

1. A method of controlling the rolling efficiency in a continuous hot rolling process, comprising the steps of:

sequentially charging into a heating furnace a plurality of slabs at a charging point;

sequentially extracting from said heating furnace said charged slabs;

inputting a total weight of and the time intervals of slabs already extracted from said heating furnace in a past period extending from a predetermined previous time up to the present time, a total weight and a forecast furnace residence time of slabs charged in said heating furnace and a total weight of any number of slabs to be charged;

calculating a desired rolling efficiency of said slabs to be charged to thereby control the overall average rolling efficiency to a predetermined value while keeping constant a time gap $TG_M$ between successive slabs at a predetermined position downstream from said charging point; and calculating said time gap according to the equation:

$$TG_M = \frac{1}{n_R}\left(\frac{W_M}{TPH_M} - \sum_{i=1}^{n_R} t_i\right),$$

wherein $TPH_M$ is the rolling efficiency in said past period, $n_R$ is the number of slabs, having a total weight $W_M$, located between two predetermined points, and $t_i$ is a rolling time for the i-th of said $n_R$ slabs.

2. A method as recited in claim 1, further comprising the step of forecasting an extraction pitch $\tau_{Ri}$ from said heating furnace according to the equation:

$$\tau_{Ri} = T_i + TG_M.$$

* * * * *